US005189970A

United States Patent [19]

VanDuyne

[11] Patent Number: 5,189,970

[45] Date of Patent: Mar. 2, 1993

[54] CROSS-SEAM ALIGNMENT APPARATUS

[75] Inventor: Edward A. VanDuyne, Framingham, Mass.

[73] Assignee: The Charles Stark Draper Laboratory, Inc., Cambridge, Mass.

[21] Appl. No.: 763,925

[22] Filed: Sep. 23, 1991

[51] Int. Cl.[5] ..... D05B 35/04

[52] U.S. Cl. ..... 112/121.26; 112/136; 112/305; 112/306; 112/121.15; 271/230

[58] Field of Search ..... 112/121.26, 121.15, 112/305, 306, 322, 153, 318; 223/61; 271/226, 229, 230, 243, 245

[56] References Cited

U.S. PATENT DOCUMENTS 4,135,464 1/1979 Sanvito ..... 112/121.26

4,462,118 7/1984 Bowditch ..... 2/243 R 4,669,400 6/1987 Michaels et al. ..... 112/121.26

*Primary Examiner*—Peter Nerbun

*Attorney, Agent, or Firm*—Lahive & Cockfield

[57] ABSTRACT

An apparatus for aligning the cross-seams of similar lateral edges of two composite limp material segments, where each composite limp material segment includes two panels joined at a cross-seam extending transversely from corresponding points in the lateral edges-to-be-aligned. Following alignment of the cross-seams of the lateral edges, the segments are fed from the apparatus with the lateral edges and corresponding points of the cross-seams in overlapping alignment. Thereafter, the aligned edges may be joined using a conventional sewing machine.

3 Claims, 6 Drawing Sheets

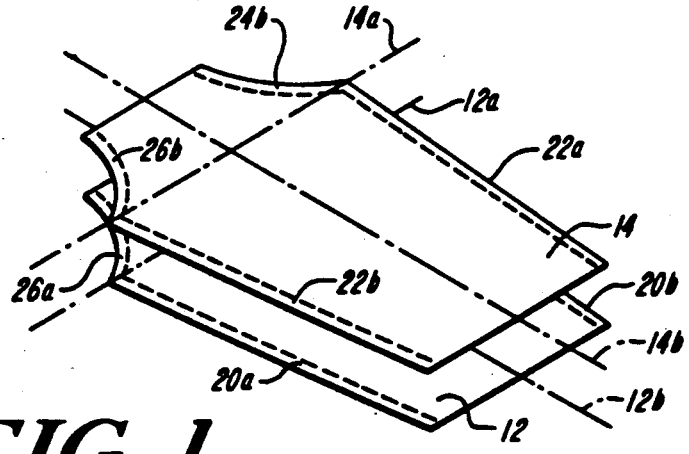
FIG. 1
FIG. 2
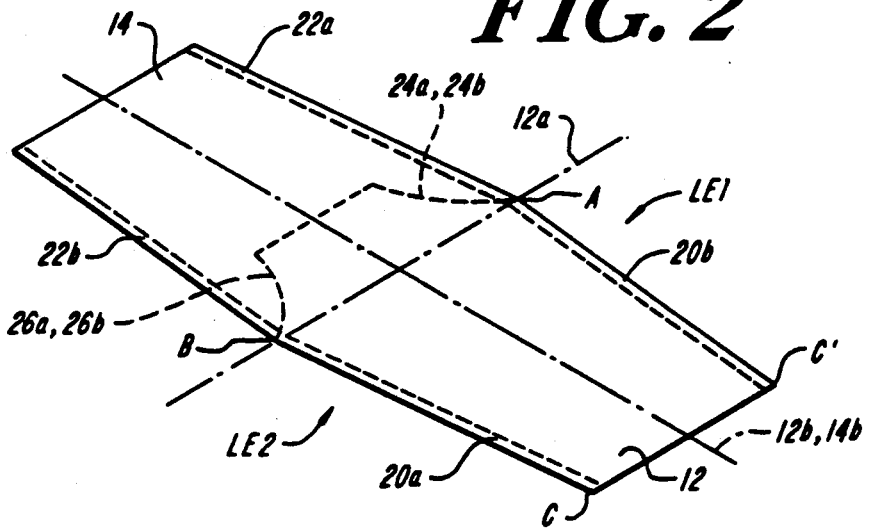
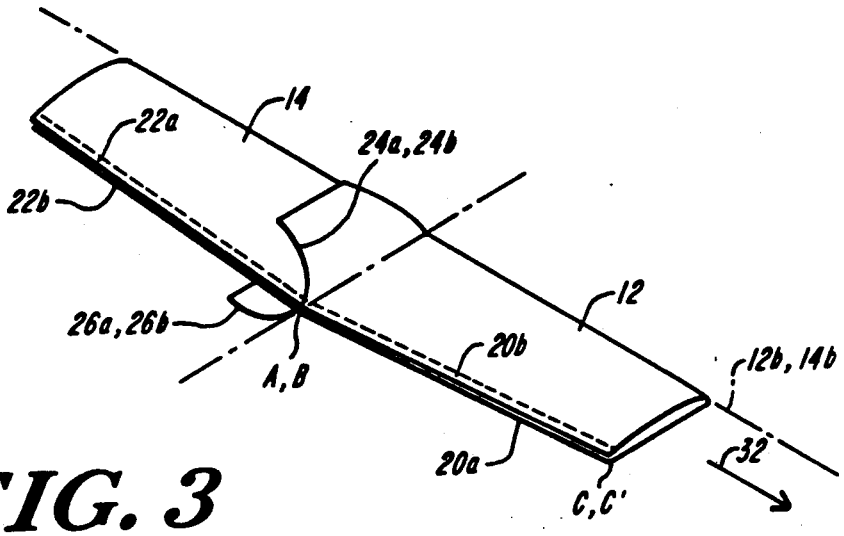
FIG. 3

CROSS-SEAM ALIGNMENT APPARATUS

BACKGROUND OF THE INVENTION

The present invention is in the field of clothing manufacture, more particularly relating to the automated assembly of garments.

Garments have long been made by joining two or more panels of limp fabric, forming seams, so that the composite surface of the joined panels establishes a desired three-dimensional contour. Typically, the design process for a garment includes the step of segmentation of the desired finished contour into planar patterns having shapes corresponding to panels for the garment. These patterns are used to generate the panels which may be cut from a portion of a limp fabric. The panels are then joined at their edges (by manual or machine sewing) to form the finished garment. For automated garment assembly, it is preferable that the design permits the joining operation to be performed in a plane. In most cases, however, in the prior art, the seam joining for a garment requires three dimensional positioning of the joining stitches. As a result, such seam joining is generally accomplished manually.

Thus, to manufacture a garment using planar patterns, the patterns are used to define the contours of panels on a portion of fabric, and the panels are then cut from that portion. Thereafter, the cut panels are joined to form the garment. In order to efficiently produce large numbers of garments, for example in commercial production, the panels may be cut from elongated strips of fabric extending from bolts of fabric. Various computer controlled systems have been developed in the prior art to accomplish garment production from such bolts of fabric. For example, there are known systems for automatically laying out panels, accommodating a full range of garment sizes, on a strip of material from a bolt which maximizes fabric utilization (i.e., minimizes waste). There are also computer controlled cutting systems, for example using reciprocating knives, which accurately and quickly cut panels from a large number of strips at one time. Further, there are systems which can automatically position the cut panels so that certain of their edges-to-be-joined may be joined by sewing, or fusing, under the control of a computer.

One of the principle limitations of the prior art clothing assembly techniques is that most automatic, or computer controlled, joining systems can only effectively perform panel edge joining in a flat plane, i.e., the seam must lie in a plane. Since many garments include seams which may be formed in a flat plane, automated systems have been very effective in enabling the efficient production of garments or other articles. For example, U.S. Pat. No. 3,699,591 shows a system for manufacturing simple garments which include only flat plane seams which may readily be performed by known systems. Similarly, U.S. Pat. No. 4,462,118 shows a method for assembling pants from two substantially identical fabric panels using flat plane seams for joining two panels.

However, most garments must be assembled with at least some seams which are not flat plane seams, i.e., the garment design includes seams which cannot be formed in a plane. By way of example, a pair of pants might be formed from two panels which are joined with an inseam and crotch seam intersecting at a saddle region, with the inseam extending between the lowermost portions of the leg portions of the pants and the crotch seam extending between two points on the top of the pants. Using conventional assembly techniques for such pants, one of these seams is first formed in its entirety and then the other is formed using other than automated flat plane sewing techniques. In order to assemble such garments in the prior art, these non-flat plane seams cannot be formed using known automated seam-joining systems, but rather must be formed either by hand or, more typically, human operator-controlled feeding of the panels to a sewing machine (or other type of machine) head. Consequently, the labor cost is relatively high compared to that encountered for a garment which might be assembled entirely by a computer system.

However, U.S. Pat. No. 4,462,118, assigned to the assignee of this application, discloses a method for forming pants having such intersecting crotch and inseams where all seam joining is performed in a flat plane. One requirement for that method is that the cross-seams be mutually aligned prior to completion of the inseam. While this step is easily performed with human intervention, there are no known automated mechanisms which can perform this step. With such a mechanism, fully automated assembly of pants could readily be performed.

Accordingly, it is an object of the present invention to provide an improved apparatus of garment manufacture.

It is yet another object of the invention to provide an apparatus for aligning cross-seams during the assembly of articles using flat plane seam joining techniques.

SUMMARY OF THE INVENTION

The present invention is directed to an apparatus for aligning the cross-seams of similar lateral edges of two stretchable composite limp material segments, where each composite limp material segment includes two panels joined at a cross-seam extending transversely from corresponding points on the lateral edges-to-be-aligned. Following alignment of the cross-seams of the lateral edges, the segments are fed from the apparatus with the corresponding points (of the cross-seams) in overlapping alignment. Thereafter, the aligned edges may be joined using a conventional sewing machine, for example.

In the preferred form of the invention, the apparatus includes a support table having a ply separator plate disposed above the table. A segment feed assembly is positioned near the downstream end of the table. A positioning assembly is adapted to initially position the composite limp material segments adjacent to opposite sides of the separator plate with the lateral edges of the segments in nominal overlapping alignment and with the downstream portions of those lateral edges in substantial overlapping alignment and held adjacent to the table.

In one form of the invention, a tension device is adapted to apply a desired force to the trailing portion of each of the segments to continuously establish tension (in a predetermined manner or adaptively) in that segment.

A seam aligner assembly includes a body member that is slidingly (in the feed direction) coupled to the table. Two elongated finger elements, extend in parallel from the body member in a direction transverse to the feed direction and opposite, and separated by a gap from, the respective sides of the ply separator plate. The gap is selected to be greater than the thickness of the panels of the segments but less than the thickness of the cross-seams. The seam aligner is biased in the upstream direction.

The system operates to initially position the segments with the lateral edges and cross-seams in nominal overlapping alignment with the leading edges in substantial overlapping alignment. Then, the tension device, when present, is actuated to establish the desired tension in the segments, followed by placement of the finger elements over the segments downstream of the cross-seams. Then, the feed assembly is actuated to drive the segments from the apparatus. As the segments are so driven, first one cross-seam and finally the other engages a respective one of the finger elements. Following such engagement, the seam aligner is driven toward the downstream end of the table in response to the forces applied by the cross-seams to the respective finger elements, and the segments are drawn together with the cross-seams substantially aligned.

BRIEF DESCRIPTION OF THE DRAWINGS

The foregoing and other objects of this invention, the various features thereof, as well as the invention itself may be more fully understood from the following description, when read together with the accompanying drawings in which:

FIGS. 1-3 show an exemplary limp material workpiece for use with the present invention;

BRIEF DESCRIPTION OF THE PREFERRED EMBODIMENT

Briefly, the present invention is directed to an apparatus for bringing into overlapping alignment the cross-seams of similar lateral edges of two stretchable composite limp material segments, where each composite limp material segment includes two panels joined at a cross-seam extending transversely from corresponding points on the lateral edges-to-be-aligned. Following alignment of the cross-seams of the lateral edges, the segments are fed from the apparatus with the corresponding points of the cross-seams in overlapping alignment. Thereafter, the aligned edges may be joined using a conventional sewing machine, for example.

The invention may be used to align the lateral edges of two discrete composite limp material segments, or, alternatively, two different lateral edges of the same composite limp material segment (where the portions of that segment bearing the two lateral edges-to-be-aligned are each considered to be a separate segment). The latter case is illustrated in FIGS. 1-3 which shows two panels 12, 14 having edges 20*a*, 20*b*, 24*a*, 26*a* (panel 12) and 22*a*, 22*b*, 24*b*, 26*b* (panel 14). Panels 12, 14 are initially overlaid (FIG. 1), then sewn to join edges 24*a* and 24*b* and to join edges 26*a* and 26*b* and then unfolded along axis 12*a* (FIG. 2), and then folded along axis 12*b* (FIG. 3). As folded in this manner, the upper portions of panels 12 and 14 establish a first composite segment S1 having a first lateral edge (LE1) composed of edges 20*b* and 22*a* and a cross-seam composed of joined edges 24*a* and 24*b* extending transversely from point A. In a similar manner, the lower portions of panels 12 and 14 establish a second composite segment S2 having a second lateral edge (LE2), similar to lateral edge LE1, composed of edges 20*a* and 22*b* and a cross-seam composed of joined edges 26*a* and 26*b* extending transversely from point B. As illustrated in FIG. 3, the lateral edges LE1 and LE2, as well as corresponding points A and B, are in substantial overlappinq alignment. Lateral edges LE1 and LE2 may be joined using flat plane seam joining techniques, thereby forming a pair of pants in accordance with the teachings of U.S. Pat. No. 4,462,118.

Figure 4:
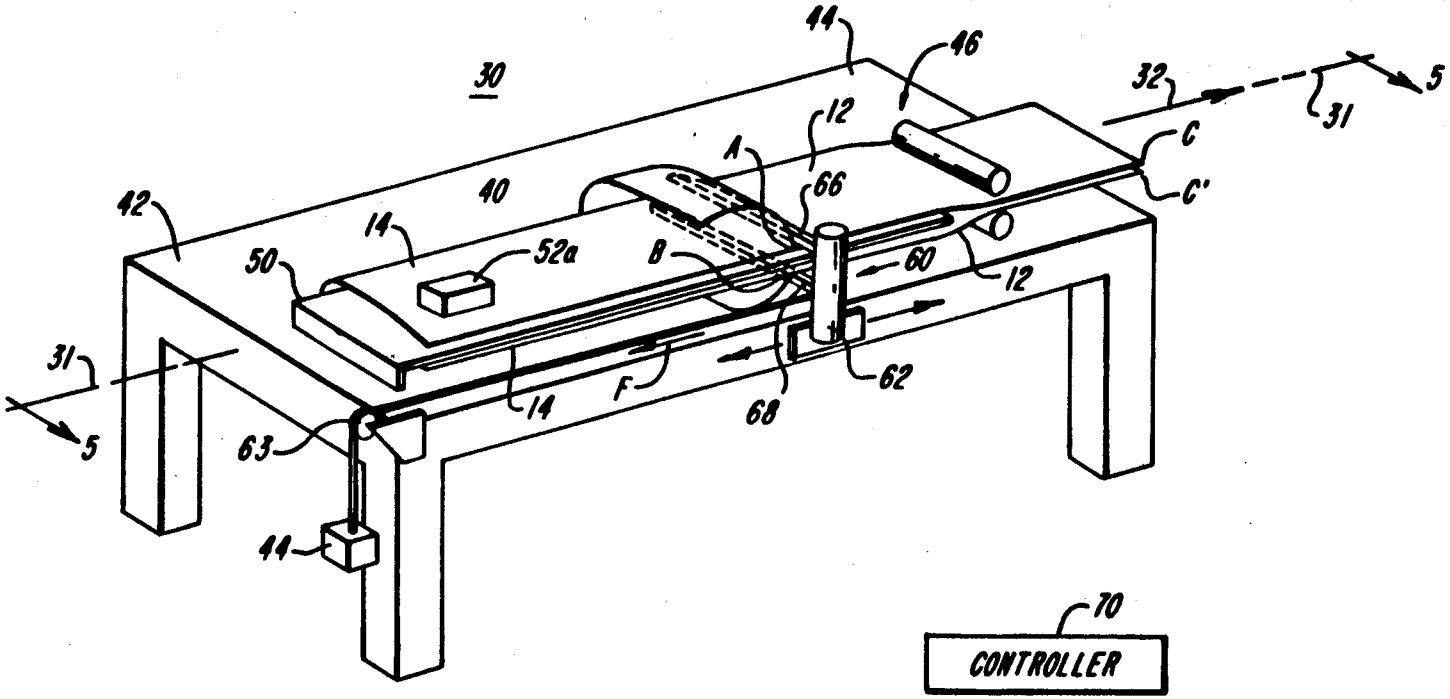
FIG. 4 shows in perspective view a cross-seam alignment system in accordance with the present invention.

FIG. 4 shows a system 30 in accordance with the present invention which is adapted to place a pair of overlapping composite limp material segments, such as those shown in FIG. 3, with the lateral edges in nominal overlapping alignment, with leading points C and C' of the lateral edges in substantial overlapping alignment. The system 30 thereafter establishes substantial overlapping alignment of the lateral edges LE1 and LE2 and corresponding points A and B while feeding the aligned panel from the system 10 in the direction of a feed axis 32.

System 30 includes an elongated support table 40 extending generally in the direction of the feed axis 31 from an upstream end 42 to a downstream end 44. As used herein, the terms "upstream" and "downstream" are in reference to the feed direction indicated by arrow 32 along feed axis 31. A feed assembly 46 is disposed near the downstream end of table 44. Assembly 46 is adapted to selectively drive limp material segments adjacent to it from the system 30 in the direction of arrow 32. In the illustrated embodiment, assembly 46 includes a simple pair of opposed rollers, but other conventional fabric drivers might readily be used, for example, a sewing head with associated feed dog fabric drivers. Fabric edge position controllers (active or passive) may be integrated with system 30 at the downstream end of table 40.

A rigid planar ply separator plate 50 is disposed horizontally above, and separated from the table 40, extending from points near upstream end 42 of table 40. In the present embodiment, the location of the plate 50 is fixed with respect to the top of table 40. Preferably, the principal (upper and lower) surfaces of plate 50 are smooth, so as to permit nearly frictionless passage of a limp material workpiece on those surfaces. In the illustrated embodiment, which is particularly adapted to align the lateral edges of limp material segments in the folded form shown in FIG. 3, plate 50 is supported so that the rear edge (as shown in FIG. 4) of that plate is free to receive that folded limp material segments, with the first composite limp material segment S1 positioned adjacent to and above plate 50, and the second composite limp material segment S2 positioned adjacent to and below plate 50. In alternative embodiments, the invention may be configured with plate 50 (and feed axis 32) other than horizontal, for example vertical, and without a support table.

Figure 5:
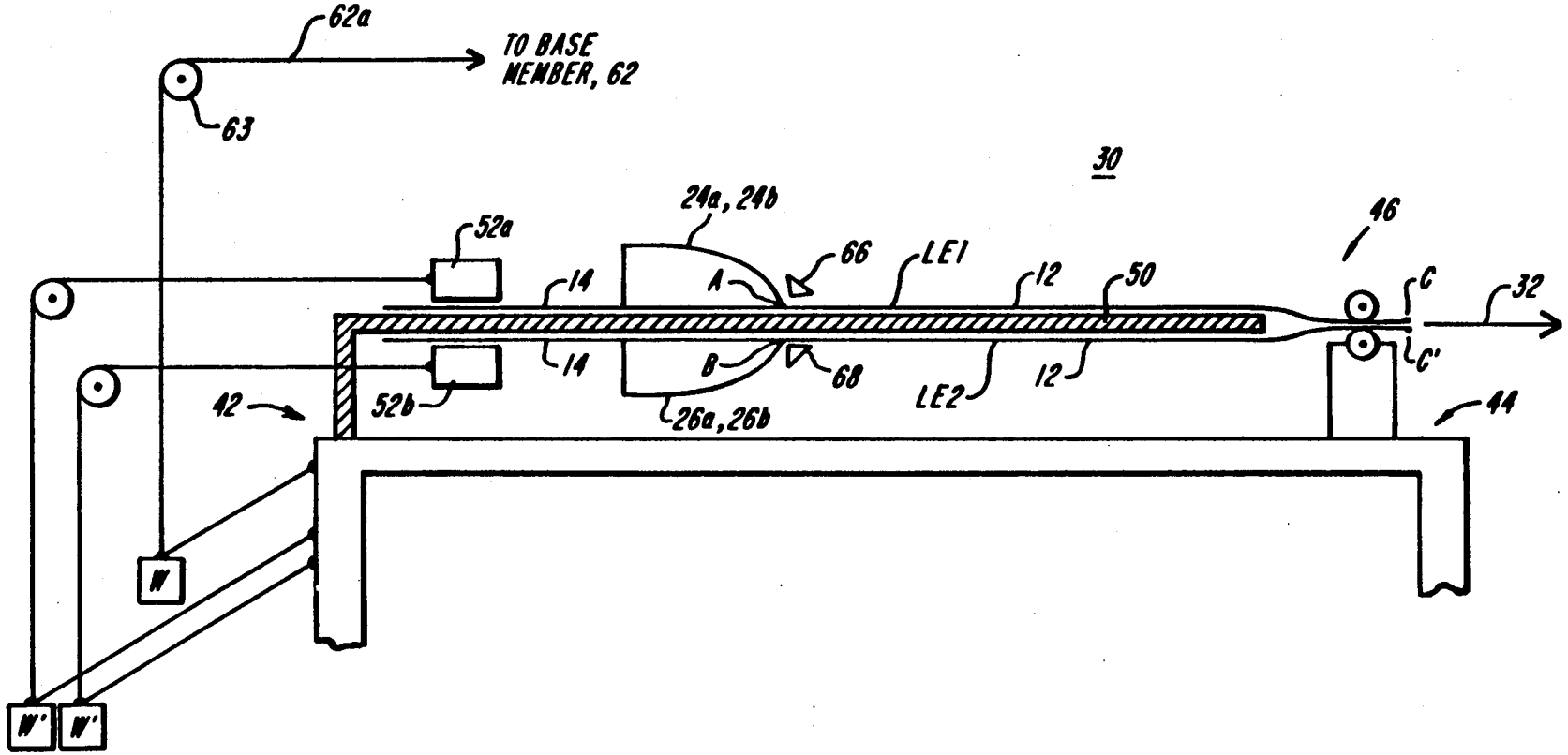
FIG. 5 shows in section, the cross-seam alignment system of FIG. 4.

In the illustrated embodiment of FIGS. 4 and 5, tension devices 52*a* and 52*b* are slidingly coupled to table 40 near its upstream end 42. Devices 52*a* and 52*b* are each adapted to selectively apply a force in the direction opposite to the feed direction 32 to the trailing portion of a respective one of limp material segments S1 and S2 adjacent to the surfaces of plate 50. Tension devices 52*a* and 52*b* are adapted to slide in the direction of the feed axis 31. The tension devices, when operating, establish a drag tension in the composite limp material segments S1 and S2 positioned adjacent to plate 50. Moreover, as the segments are driven in the feed direction 32, the tension devices 52*a* and 52*b* track the motion of the trailing portions, while maintaining a desired tension in the segments. The tension devices may be active devices, with a servo-controlled mechanism for slidingly positioning those devices in the direction of axis 31 along table 40. Alternatively, the devices 52*a* and 52*b* may be passive devices which passively provide a predetermined force to the trailing portions of the segments. In the latter case, the force may be established by coupling a free weight by way of cables extending from the devices 52*a* and 52*b* over pulleys to the upstream end 42 of table 40 and to the trailing portions of the upper segments.

A cross-seam aligner assembly 60 is also slidingly coupled to table 40, between the tension devices 52*a* and 52*b* and the feed assembly 46. Aligner assembly 60 includes a base member 62, and two elongated finger element 66 and 68 extending parallel from the base member 62 and transverse to the feed axis 31. The base member 62 is subjected to a bias force in the upstream direction (i.e. opposite feed direction 32) established by a passive force assembly. In the illustrated embodiment, the passive force assembly establishes a force F on body member 62 by coupling a free weight W thereto by way of a cable 62*a* extending from base member 62 over pulley 63 to the upstream end of table 40.

The distal end of finger element 66 is disposed above, and separated by a gap G from, the upper surface of plate 50. The distal end of finger element 68 is disposed below, and separated by a gap G' from, the lower surface at plate 50. The gaps G and G' are greater than the thickness of the panels of the composite limp material segments but are less than the vertical (when in adjacent to plate 50) thickness of the cross-seams joining the panels of the respective composite segments. In operation, as described more fully below, the aligner assembly 60 is initially positioned (with respect to axis 31) so that the finger elements are adjacent to the portions of the composite limp material segments that are downstream of the cross-seams. As a consequence, as the segments are drawn in direction 32 by feed assembly 46, the cross-seams of both composite segments S1 and S2 eventually come into interfering engagement with a respective one of finger elements 66, 68. When both cross-seams are so engaged, the interference from both cross-seams on finger elements 66, 68 is sufficient to overcome the bias force F and to drive the seam aligner assembly 60 in the direction 32.

With this operation, as the upper segment S1 and lower segment S2 are initially drawn in the feed direction 32 by assembly 46, both segments S1 and S2 advance until the cross-seam closest to the downstream end of table 40 engages the finger element on its side of plate 50. Then, as the feed assembly 46 continues to feed both segments, the segment having its cross-seam engaged with a finger stretches (since the force on just one of fingers 66, 68 is insufficient to overcome the bias force F, and move assembly 60) while the other segment is fed freely (without stretch) until its cross-seam interferingly engages the finger element on its side of plate 50. Thereafter, since the force on both finger elements 66, 68 is sufficient to overcome the bias force F and move assembly 60, the segments are thereafter fed with substantially the same amount of stretch in the feed direction, and with the cross-seams (points A and B) in overlapping alignment, with assembly 60 tracking that motion. By selecting the magnitude of weight W, the amount of tension (which determines the stretch) in the two segments can be controlled; greater weight causes greater stretch and lesser weight causes lesser stretch.

With the illustrated embodiment, the cross-seam alignment and stretch control is established in a passive manner, since those factors are determined by the weight W and the force necessary to move assembly 60 in opposition to the bias force F.

Figure 6:
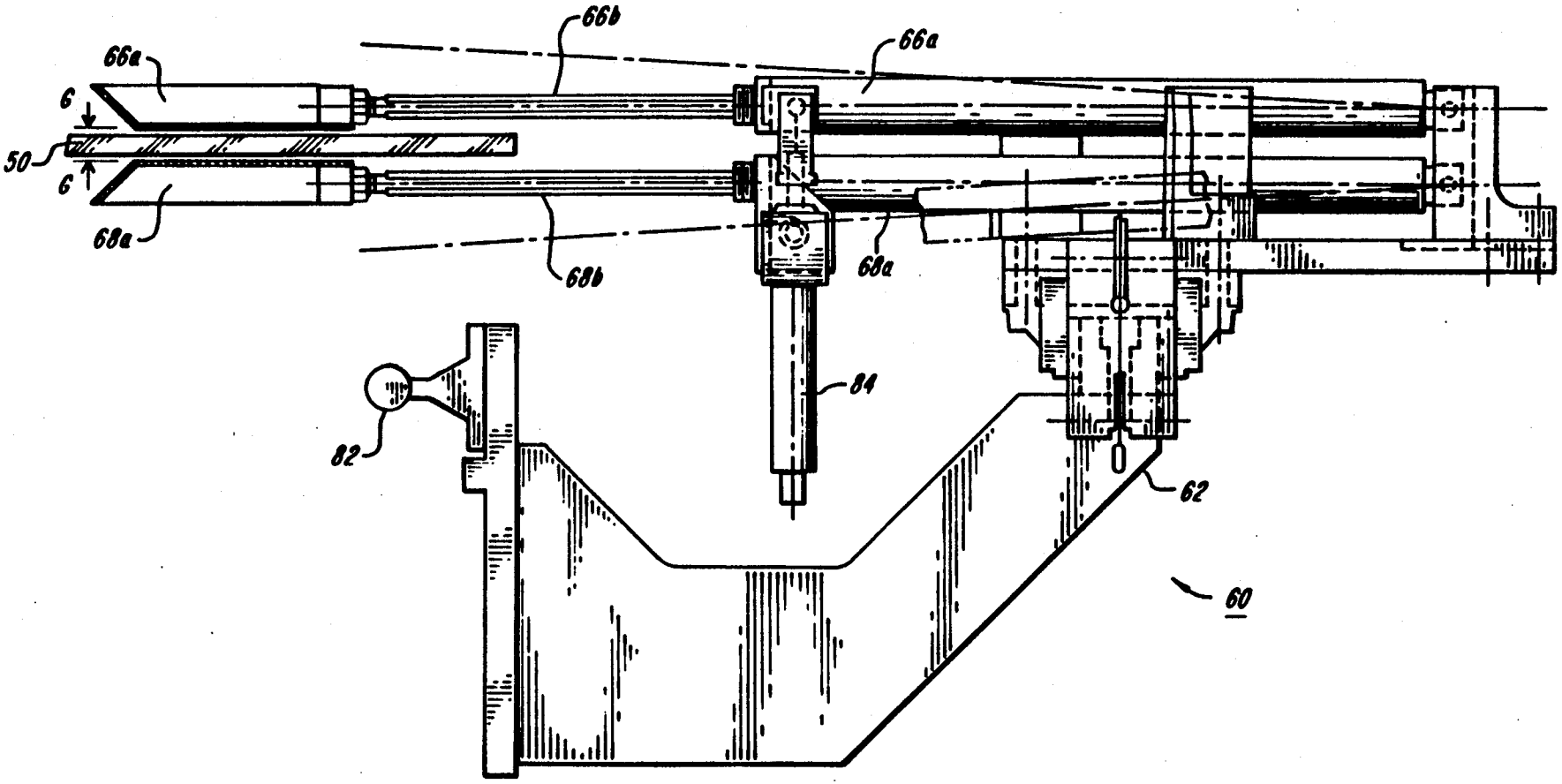
FIG. 6 shows a side elevation view of a preferred cross-seam aligner assembly for the system of FIGS. 4 and 5.

FIG. 6 shows a preferred form of the aligner assembly 60. In that form, the base member 62 is coupled to table 40 by a ball slide element 82. The finger elements 66 and 68 include engager members 66*a* and 68*a*, respectively, extending from rods 66*b* and 68*b* of air cylinders 66*c* and 68*c*, respectively. The rods 66*b* and 68*b* have a hexagonal cross-section so that the members 66*a* and 66*b* may be maintained in position without rotating. With this configuration, the finger elements 66 and 68 may be selectively withdrawn during the loading of the composite limp material segments. The finger elements 66 and 68 may also be angularly separated through the actuation of an air cylinder 84.

A controller 70, such as a programmed digital computer, is adapted to control the various elements of system 30 to operate in the manner shown in FIGS. 7A–7E.

Figure 7A:
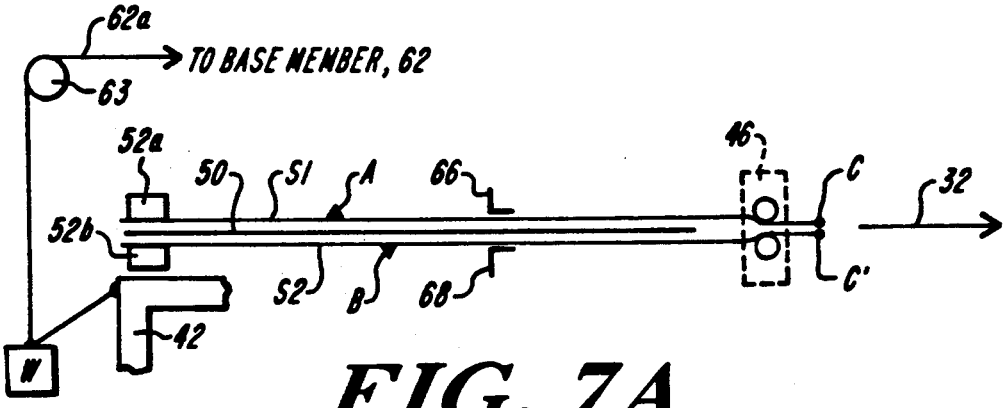
FIGS. 7A-7E illustrate the operation of the system of FIGS. 4 and 5.

Initially, the first and second composite limp material segments are positioned on opposite sides of separator plate 50 with the lateral edges to be aligned in nominal overlapping alignment, with the leading edges C, C' in substantial overlapping alignment. In the illustrated configuration, points A and B are initially not in overlapping alignment. The segment portions bearing points C and C' are held in place at the feed assembly 46. The tension devices 52*a* and 52*b* are coupled to the trailing portions of the segments S1 and S2, and the devices 52*a* and 52*b* are operated to establish a continuing desired tension in the segments. During this operation, the rods 66*b* and 68*b* of the aligner assembly 60 are in their retracted positions. The cross-seam aligner 60 is then positioned against bias force F positioned so that members 66*a* and 68*a* of the finger elements 66 and 68 are downstream of the cross-seams of the two segments. The resultant configuration is shown in FIG. 7A.

Figure 7B:
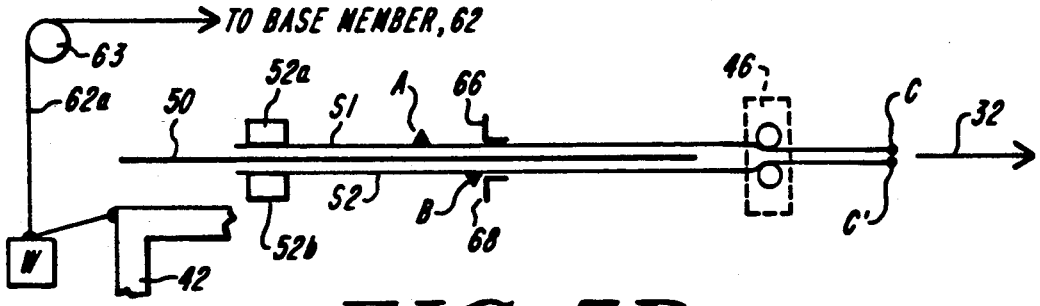
Figure 7C:
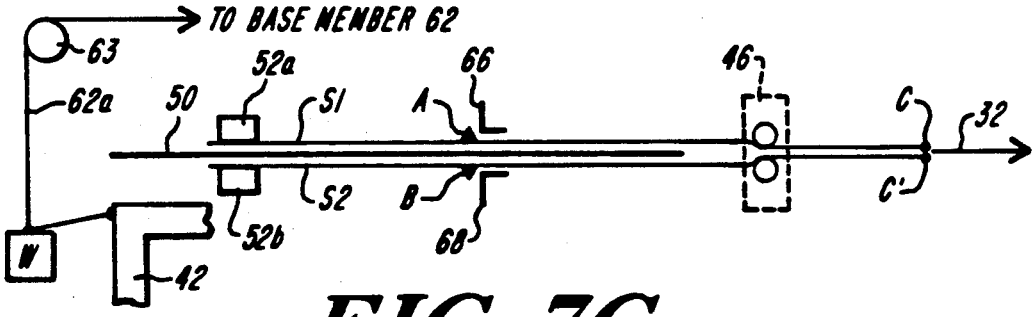

Then, the feed assembly 46 is operated to pull the aligned portions of the two segments therethrough and to feed those aligned portions out of system 10. Initially, both the upper and lower segments S1 and S2 are driven (by assembly 46) together in the feed direction 32 until the forwardmost cross-seam B comes in contact with finger element 68, as shown in FIG. 7B. Then, as assembly 46 continues to drive the segments in direction 32, segment S1 continues to be driven in direction 32 while the seam B remains stationary as the portion of segment S2 downstream of seam B is stretched. This operation continues until both seams A and B are adjacent to the finger elements 66, 68, as shown in FIG. 7C.

Figure 7D:
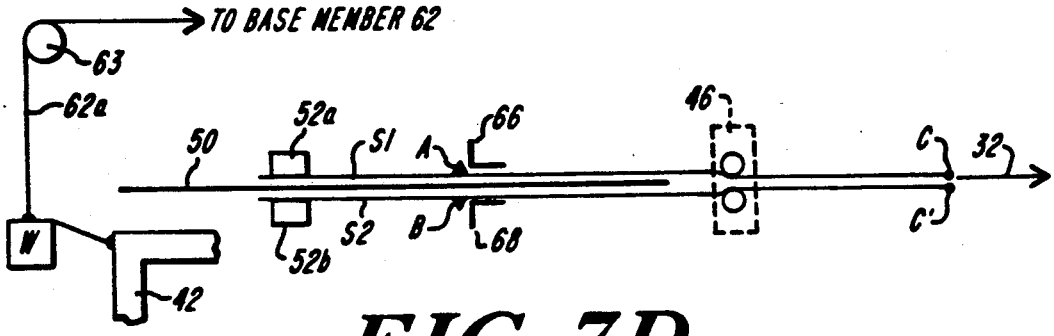
Figure 7E:
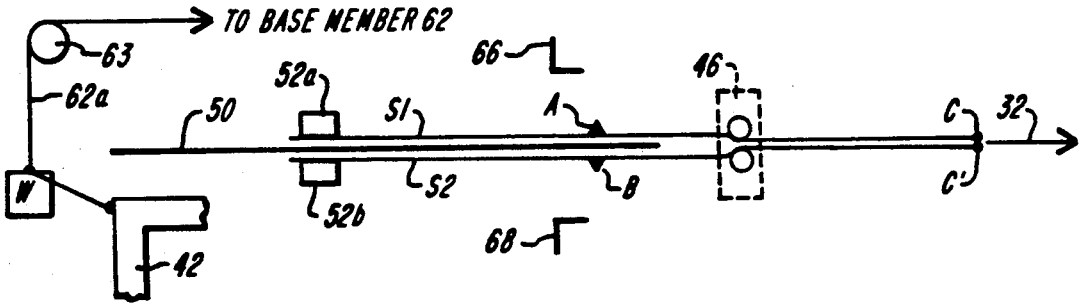

As assembly 46 continues to drive the segments in direction 32, the seams A and B apply a force to finger elements 66, 68 that is sufficient to overcome the bias force F and drive assembly 60 in direction 32, as shown in FIG. 7D. Finally, as assembly 60 nears feed assembly 46, the controller 70 causes finger elements 66, 68 to lift away from plate 50 (FIG. 7E) and retract rods 66*b* and 68*b*, permitting the cross-seam portions of segments S1 and S2 to be fed from system 30 with the seams A and B in substantial overlapping alignment. The bias force F then drives the assembly 60 back to its start point, awaiting loading of the next workpiece.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for aligning a lateral edge of a first stretchable composite limp material segment with a similar lateral edge of a second stretchable composite limp material segment, each of said first and second segments including two panels joined at a cross-seam extending transversely from corresponding points on said lateral edge, whereby said corresponding points are in substantially overlapping alignment, and for feeding said segments from said apparatus with said corresponding points overlappingly aligned in a feed direction extending from upstream points to downstream points along a feed axis, comprising:

A. a selectively operable feed assembly near said downstream points, said feed assembly including means for driving therefrom limp material segments adjacent thereto in said feed direction;

B. a ply separator including a planar rigid plate, said plate having its principal plane substantially parallel to said feed axis, said plate extending from points near said upstream points to points near said downstream points and upstream from said feed assembly;

C. selectively operative receiving means for initially receiving said first and second limp material segments adjacent to opposite sides of said plate whereby said lateral edges of said first and second segments are in nominal overlapping alignment and the ends of said lateral edges closest to said downstream points are in overlapping alignment and held adjacent to said feed assembly; and D. a selectively operable cross-seam aligner including:

i. a body member adjacent to said plate and associated means for enabling motion of said body member with respect to said plate in said feed direction;

ii. bias means for applying a bias force F to said body member, said force F being directed opposite to said feed direction;

iii. a first elongated finger element extending from said body member and being selectively positionable to extend transverse to said feed axis and opposite from a first side of said plate of said ply separator and means for selectively separating said first finger element from said ply separator by a gap G, where G is greater than the thickness of each of said panels of said first composite limp material segment and is less than the thickness of said cross-seam thereof; and iv. a second elongated finger element extending from said body member and being selectively positionable to extend substantially parallel to said first finger element and transverse to said feed axis and opposite a second side of said plate of said ply separator and means for selectively separating said second finger element from said ply separator by a gap G', where G' is greater than the thickness of each of said panels of said second composite limp material segment and is less than the thickness of said cross-seam thereof.

2. Apparatus according to claim 1, further comprising a controller including means for sequentially:

i. operating said receiving means;

ii. operating said cross-seam aligner whereby said first and second finger elements are positioned downstream of said cross-seams of respective ones of said first and second composite limp material segments; and iii. operating said feed assembly whereby portions of said first and second segments are fed from said feed assembly in said feed direction with said corresponding points being overlappingly aligned.

3. Apparatus according to claim 1, further comprising:

tension means for applying on a continuous basis a force directed opposite to said feed direction to at least one of said segments, said force being applied to points on said segment near the end of said lateral edge of said segment closest to said upstream points.

* * * * *